US008325208B2

(12) United States Patent
Han et al.

(10) Patent No.: US 8,325,208 B2
(45) Date of Patent: Dec. 4, 2012

(54) METHOD FOR PROCESSING DATA, DRIVING APPARATUS FOR PERFORMING THE METHOD AND DISPLAY APPARATUS HAVING THE DRIVING APPARATUS

(75) Inventors: Young-Su Han, Incheon (KR); Jae-Hyoung Park, Asan-si (KR); Po-Yun Park, Asan-si (KR); Byung-Kil Jeon, Anyang-si (KR); Chang-Soo Lee, Uijeongbu-si (KR); Bo-Ra Kim, Asan-si (KR)

(73) Assignee: Samsung Display Co., Ltd. (KR)

( * ) Notice: Subject to any disclaimer, the term of this patent is extended or adjusted under 35 U.S.C. 154(b) by 467 days.

(21) Appl. No.: 12/628,635

(22) Filed: Dec. 1, 2009

(65) Prior Publication Data

US 2010/0149228 A1 Jun. 17, 2010

(30) Foreign Application Priority Data

Dec. 12, 2008 (KR) ..... 10-2008-0126712

(51) Int. Cl.
*G09G 5/02* (2006.01)

(52) U.S. Cl. ..... 345/694

(58) Field of Classification Search ..... 345/694, 345/545, 204, 99, 98, 90, 88, 87; 348/311
See application file for complete search history.

(56) References Cited

U.S. PATENT DOCUMENTS

| | | | | |
|---|---|---|---|---|
| 6,628,355 | B1 * | 9/2003 | Takahara | 349/106 |
| 7,209,111 | B2 * | 4/2007 | Kurokawa et al. | 345/99 |
| 7,439,940 | B1 * | 10/2008 | Maguire, Jr. | 345/7 |
| 7,565,007 | B2 * | 7/2009 | Ishiga | 382/162 |
| 7,663,685 | B2 * | 2/2010 | Inuiya | 348/315 |
| 7,834,835 | B2 * | 11/2010 | Kurokawa et al. | 345/87 |
| 7,978,273 | B2 * | 7/2011 | Takeuchi et al. | 349/39 |
| 2004/0012581 | A1 * | 1/2004 | Kurokawa et al. | 345/204 |
| 2007/0164964 | A1 | 7/2007 | Ha | |
| 2010/0177107 | A1 * | 7/2010 | Park et al. | 345/545 |

FOREIGN PATENT DOCUMENTS

| | | | |
|---|---|---|---|
| KR | 1020050020265 | A | 3/2005 |
| KR | 1020070043314 | A | 4/2007 |
| KR | 1020070075584 | A | 7/2007 |

OTHER PUBLICATIONS

Extended Search Report for Application No. 09014971.7-2205 dated Sep. 15, 2011.

* cited by examiner

*Primary Examiner* — Fred Tzeng
(74) *Attorney, Agent, or Firm* — Cantor Colburn LLP

(57) ABSTRACT

A method for processing image data, the image data including a plurality of sub color data corresponding to a plurality of unit pixels in a row direction, wherein each unit pixel includes N sub color data having different colors, wherein N is a natural number greater than or equal to 2, includes; storing one sub color datum of the plurality of the sub color data corresponding to the unit pixels via dividing the plurality of the sub color data one by one into an individual sub color datum corresponding to a single pixel, and reading the stored sub color data, binding up the stored sub color data two by two, and storing two sub color data bound up with each other.

20 Claims, 8 Drawing Sheets

METHOD FOR PROCESSING DATA, DRIVING APPARATUS FOR PERFORMING THE METHOD AND DISPLAY APPARATUS HAVING THE DRIVING APPARATUS

This application claims priority to Korean Patent Application No. 2008-126712, filed on Dec. 12, 2008, and all the benefits accruing therefrom under 35 U.S.C. §119, the contents of which in its entirety are herein incorporated by reference.

BACKGROUND OF THE INVENTION

1. Field of the Invention

Exemplary embodiments of the present invention relate to a method for processing data, a driving apparatus for performing the method and a display apparatus having the driving apparatus. More particularly, exemplary embodiments of the present invention relate to a method for processing data enhancing driving reliability, a driving apparatus for performing the method and a display apparatus having the driving apparatus.

2. Description of the Related Art

In general, a typical liquid crystal display ("LCD") apparatus includes an LCD panel, a printed circuit board ("PCB") on which a driving chip is mounted to drive the LCD panel, source tape carrier packages ("TCPs") on which source driving chips are mounted to electrically connect the PCB to the LCD panel, and gate TCPs on which gate driving chips are mounted.

In order to decrease the size of the LCD apparatus and reduce associated manufacturing costs, a gate-IC-less ("GIL") structure in which the gate TCPs have been removed and a gate driving circuit is formed directly on the LCD panel has been developed and applied.

In addition, a horizontal pixel structure having different color pixels disposed along one data line is applied to decrease the size of a source driving chip. In the horizontal pixel structure, a relatively longer side of red, green and blue color pixels is formed along a horizontal direction, and a relatively shorter side of the red, green and blue color pixels is formed along a vertical direction.

When the horizontal pixel structure is applied, the red, green and blue color pixels are connected to substantially the same data line, so that a horizontal period 1H may be divided into ⅓H. Thus, the number of the data lines may be decreased by one-third. However, a time available for data voltages charged to the red, green and blue pixels is also decreased by one-third, so that charging rates may be decreased and display defects may be generated.

BRIEF SUMMARY OF THE INVENTION

The present invention provides an exemplary embodiment of a method for processing data to decrease a memory size and to enhance driving reliability.

The present invention also provides an exemplary embodiment of a driving apparatus for performing the method for processing the data.

The present invention also provides an exemplary embodiment of a display apparatus having the driving apparatus.

In an exemplary embodiment of a method for processing image data according to the present invention, the image data including a plurality of sub color data corresponding to a plurality of unit pixels in a row direction, wherein each unit pixel includes N sub color data having different colors, wherein N is a natural number greater than or equal to 2, the method including; storing one sub color datum of the plurality of the sub color data corresponding to the unit pixels via dividing the plurality of the sub color data one by one into an individual color datum corresponding to a single pixel, and reading the stored sub color data, binding up the stored sub color data two by two, and storing two sub color data bound up with each other.

In an exemplary embodiment of a driving apparatus according to the present invention, the driving apparatus processes sub color data, each unit pixel includes N sub color data, and the sub color data are included in a plurality of unit pixels, wherein N is a natural number greater than or equal to 2, the driving apparatus including; a control part which generates a first data enable signal and a second data enable signal, the first data enable signal including a first pulse and a first blank, the second data enable signal including a second pulse and a second blank, the first pulse being synchronized with a pulse corresponding to one horizontal period 1H and having a width corresponding to a 1/N horizontal period, the first blank being disposed between sequential first pulses and having a period substantially equal to a blank between the pulses divided by N, the second pulse being synchronized with the first pulse and having a width corresponding to a 2/N horizontal period, the second blank being disposed between sequential second pulses and having second blank periods, and a storage part, which divides the sub color data corresponding to the unit pixels one by one in response to the first pulse, and which stores the sub color data two by two in response to the second pulse.

An exemplary embodiment of a display apparatus according to the present invention includes; a display panel including a plurality of unit pixels, each unit pixel having N sub color data, a color pixel row extending along a first direction and including a plurality of the sub color data, a color pixel column extending along a second direction substantially perpendicular to the first direction and including a plurality of the sub color data, a data line electrically connected to the color pixel row, and a gate line electrically connected to adjacent pixels of the color pixel column, and a driving apparatus which provides sub color data to the display panel, the unit pixel includes N color data, the sub color data are included in a plurality of unit pixels, wherein N is a natural number greater than or equal to 2, wherein the driving apparatus includes; a control part which generates a first data enable signal and a second data enable signal, the first data enable signal includes a first pulse and a first blank, the second data enable signal includes a second pulse and a second blank, the first pulse is synchronized with a pulse corresponding to one horizontal period 1H and has a width corresponding to a 1/N of a horizontal period, the first blank is disposed between sequential first pulses and has a period substantially equal to a blank between sequential pulses divided by N, the second pulse is synchronized with the first pulse and has a width corresponding to a 2/N of a horizontal period, the second blank is disposed between sequential second pulses and having a period substantially equal to two first blank periods, a storage part which divides the sub color data corresponding to the unit pixels one by one in response to the first pulse, and which stores the sub color data two by two in response to the second pulse.

According to exemplary embodiments of the present invention, the size of a storage part may be decreased. By securing a timing margin for storing data to the storage part and reading the data, data processing reliability may be enhanced.

BRIEF DESCRIPTION OF THE DRAWINGS

The above and other aspects, features and advantages of the present invention will become more apparent by describing in further detail exemplary embodiments thereof with reference to the accompanying drawings, in which.

DETAILED DESCRIPTION OF THE INVENTION

Figure 1:
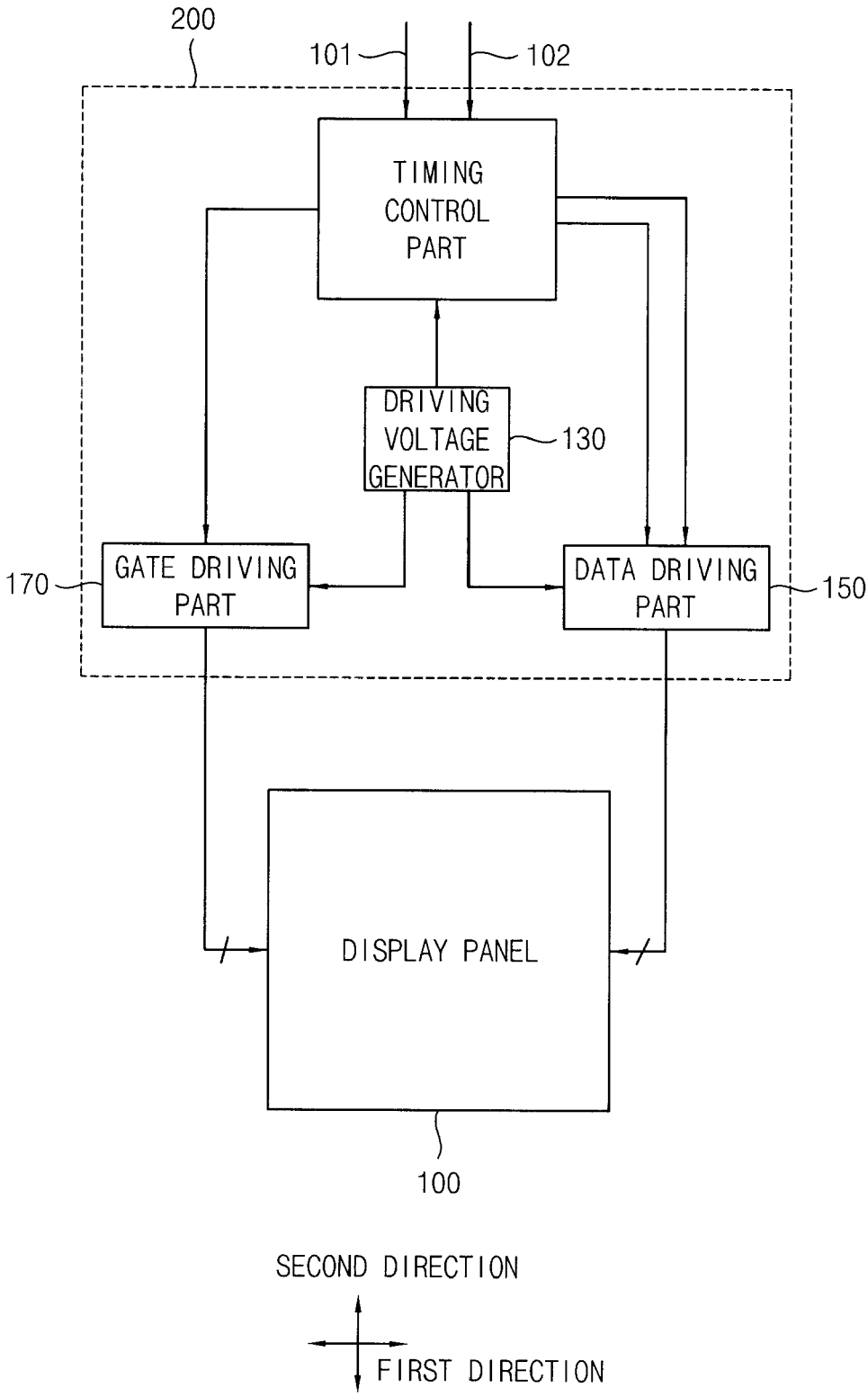
FIG. 1 is a block diagram illustrating an exemplary embodiment of a display apparatus according to the present invention.

The invention now will be described more fully hereinafter with reference to the accompanying drawings, in which exemplary embodiments of the present invention are shown. The invention may, however, be embodied in many different forms and should not be construed as limited to the exemplary embodiments set fourth herein. Rather, these example embodiments are provided so that this disclosure will be through and complete, and will fully convey the scope of the present invention to those skilled in the art. Like reference numerals refer to like elements throughout.

It will be understood that when an element or layer is referred to as being "on," another element, it can be directly on the other element or intervening elements may be present. In contrast, when an element is referred to as being "directly on" another element, there are no intervening elements. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

Figure 2:
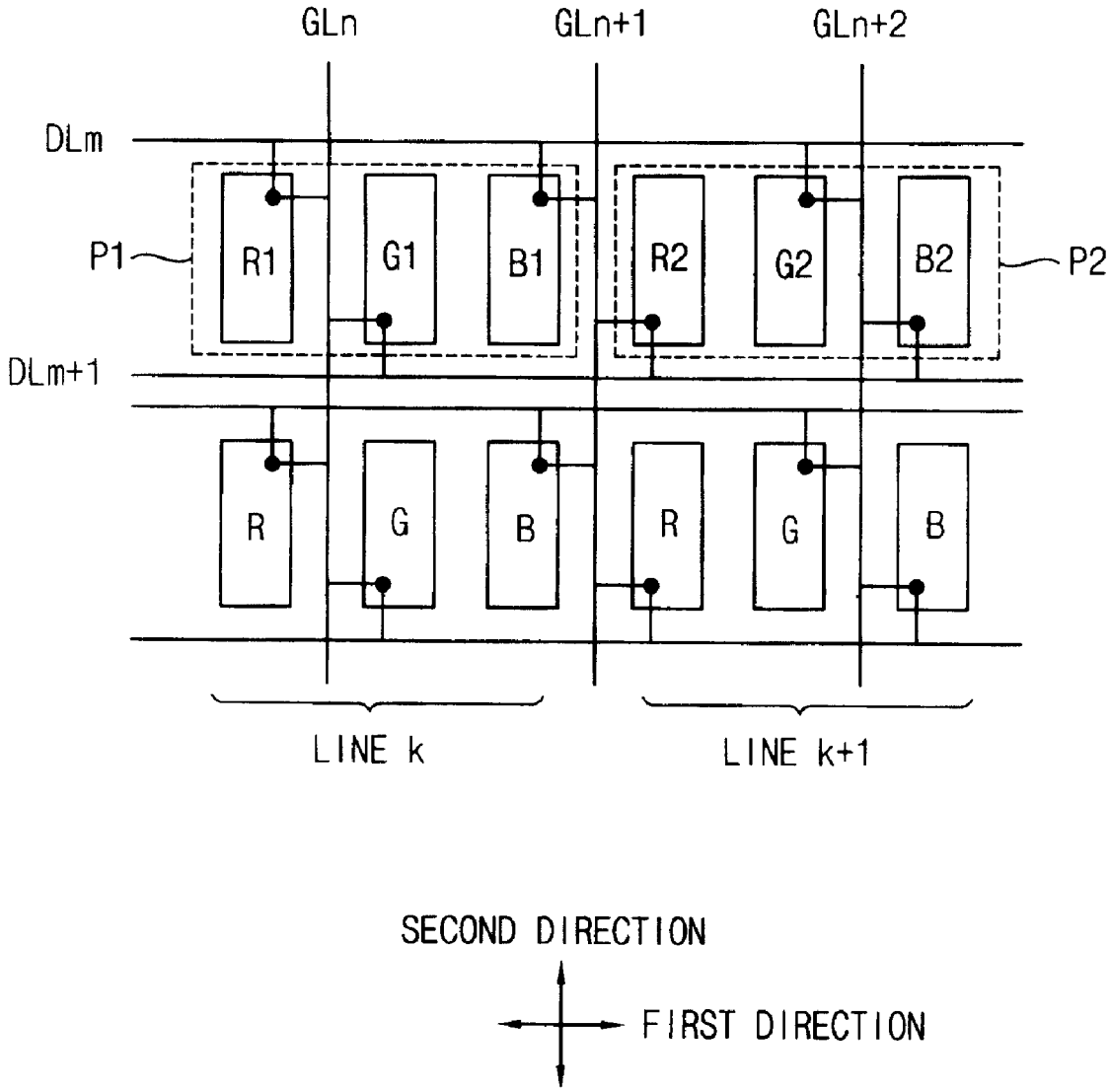
FIG. 2 is a diagrammatic top plan view illustrating an exemplary embodiment of a pixel structure of the exemplary embodiment of the display apparatus in FIG. 1.

FIG. 1 is a block diagram illustrating an exemplary embodiment of a display apparatus according to the present invention. FIG. 2 is a diagrammatic top plan view illustrating an exemplary embodiment of a pixel structure according to the exemplary embodiment of the display apparatus in FIG. 1.

Referring to FIGS. 1 and 2, the display apparatus includes a display panel 100 and a driving apparatus 200 driving the display panel 100.

A unit pixel row including a unit pixel is defined in the display panel 100. In the present exemplary embodiment, the unit pixel includes N color pixels (wherein N is a natural number greater than or equal to 2). The display panel 100 includes a first color pixel row including color pixels disposed in a first direction and a second color pixel row including color pixels disposed in a second direction, the second color pixel row disposed in the second direction may also be referred to as a color pixel column. One of the data lines is electrically connected to the first color pixel row. One of the gate lines is electrically connected to a plurality of the second color pixel rows, e.g., columns of color pixels, adjacent to each other.

As shown in FIG. 2, the present exemplary embodiment of the display panel 100 includes a plurality of data lines DLm and DLm+1, a plurality of gate lines GLn, GLn+1 and GLn+2 and a plurality of unit pixels P (wherein m and n are natural numbers). In the present exemplary embodiment, each of the unit pixels P includes a red pixel R, a green pixel G and a blue pixel B. A pair of the data lines DLm and DLm+1 extend in the first direction. The gate lines GLn, GLn+1 and GLn+2 are extended in the second direction substantially perpendicular to the first direction. In the present exemplary embodiment, a first unit pixel P1 includes a first red pixel R1, a first green pixel G1 and a first blue pixel B1 which are disposed in the recited order along the first direction. A second unit pixel P2 is disposed adjacent to the first unit pixel P1 in the first direction. The second unit pixel P2 includes a second red pixel R2, a second green pixel G2 and a second blue pixel B2 which are disposed in the recited order along the first direction.

The pair of the data lines DLm and DLm+1 is electrically, regularly and alternatively connected to the color pixels disposed in the first direction. In the present exemplary embodiment, the m-th data line DLm is electrically connected to the first red pixel R1, the first blue pixel B1 and the second green pixel G2. Also in the present exemplary embodiment, the (m+1)-th data line DLm+1 is electrically connected to the first green pixel G1, the second red pixel R2 and the second blue pixel B2.

One of the gate lines is electrically connected to two color pixels of the second color pixel row which are adjacent to each other in the first direction. In the present exemplary embodiment, the n-th gate line GLn is electrically connected to the first red pixel R1 and the first green pixel G1. Also in the present exemplary embodiment, the (n+1)-th gate line GLn+1 is electrically connected to the first blue pixel B1 and the second red pixel R2. The (n+2)-th gate line GLn+2 is electrically connected to the second green pixel G2 and the second blue pixel B2.

In one exemplary embodiment, a k-th unit pixel row LINE k and a (k+1)-th unit pixel row LINE (k+1)-th disposed in the second direction are electrically connected to three gate lines GLn, GLn+1 and GLn+2 (wherein k is a natural number). Specifically, the unit pixel row LINE k is connected to the gate lines GLn and GLn+1, while the unit pixel row LINE k+1 is connected to gate lines GLn+1 and GLn+2.

In the present exemplary embodiment, the driving apparatus 200 includes a timing control part 110, a driving voltage generator 130, a data driving part 150 and a gate driving part 170.

The timing control part 110 receives a synchronizing signal 101 and data 102 from outside. In the present exemplary embodiment, the synchronizing signal 101 includes a horizontal synchronizing signal, a vertical synchronizing signal and a data enable signal DE synchronized with the horizontal synchronizing signal. The data 102 includes red, green and blue data. The timing control part 110 generates a gate control signal and a data control signal which control driving timing of the driving apparatus 200 using the synchronizing signal 101. Exemplary embodiments also include configurations wherein the timing control part 110 includes a storage part (not shown) storing the data 102. The timing control part 110 processes data corresponding to pixel structures of the display panel 100, using an exemplary embodiment of a method for processing data which improves storage capacity and enhances data processing reliability. The method for processing data of the timing control part 110 is described with reference to FIGS. 4 and 5 as follows.

The timing control part 110 processes data of the unit pixel row including a plurality of unit pixels by binding up and dividing the data, using the received DE signal. In the present exemplary embodiment, the DE signal includes a pulse corresponding to a 1 horizontal period H and a blank period BL disposed between the pulses. Exemplary embodiments include configurations wherein the width, e.g., period, of the blank may be variable. The data of the unit pixel row includes red, green and blue data because the unit pixel includes red, green and blue pixels.

In an exemplary embodiment wherein the unit pixel row in the first direction includes two unit pixels, the timing control part 110 outputs the received data of the unit pixel row including two unit pixels two by two, after binding up and dividing the data of the unit pixel row two by two as follows. When the timing control part 110 outputs the data of the k-th and (k+1)-th unit pixel row corresponding to two horizontal periods 2H, the timing control part 110 outputs red and green data of the k-th unit pixel row for a first ⅔H. Then, for a second ⅔H, the timing control part 110 outputs blue data of the k-th unit pixel row and red data of the (k+1)-th unit pixel row. Then, for a third ⅔H, the timing control part 110 outputs green and blue data of the (k+1)-th unit pixel row. Thus, over two horizontal periods, unit pixels of both k-th and (k+1)-th unit pixel rows are supplied with data voltages.

In the present exemplary embodiment, the driving voltage generator 130 generates a driving voltage for driving a display apparatus using a source voltage received from outside. In one exemplary embodiment, the driving voltage generator 130 supplies a digital source voltage DVDD and an analog source voltage AVDD to the data driving part 150. The driving voltage generator 130 supplies a gate-on voltage VON and a gate-off voltage VOFF to the gate driving part 170.

The data driving part 150 is synchronized with the data control signal received from the timing control part 110. The data driving part 150 converts the data into a data voltage having an analog type and outputs the data voltage to the data lines on the display panel 100. In one exemplary embodiment, the data driving part 150 converts data received in a ⅔H period into a data voltage having an analog type and outputs the data voltage to the data lines DLm and DLm+1. Exemplary embodiments of the data driving part 150 may be disposed at a side edge of the display panel 100 in a direction substantially parallel with the second direction according to the pixel structure of display panel 100 in FIG. 2.

The gate driving part 170 is synchronized with the gate control signal received from the timing control part 110. The gate driving part 170 sequentially outputs a gate signal including the gate-on voltage VON and the gate-off voltage VOFF to the gate lines. In the present exemplary embodiment, the gate driving part 170 generates the gate signal to have a width of a pulse of the gate-on voltage VON level longer than ⅔H in order to improve a charging rate of the data voltage. In such an exemplary embodiment, the width of a pulse of the gate-on signal may be 8/3H as will be described in more detail below with respect to FIG. 6. In one exemplary embodiment, the gate driving part 170 may be disposed at a side edge of the display panel 100 in a direction substantially parallel with the first direction according to the pixel structures of display panel 100 of FIG. 2.

Figure 3:
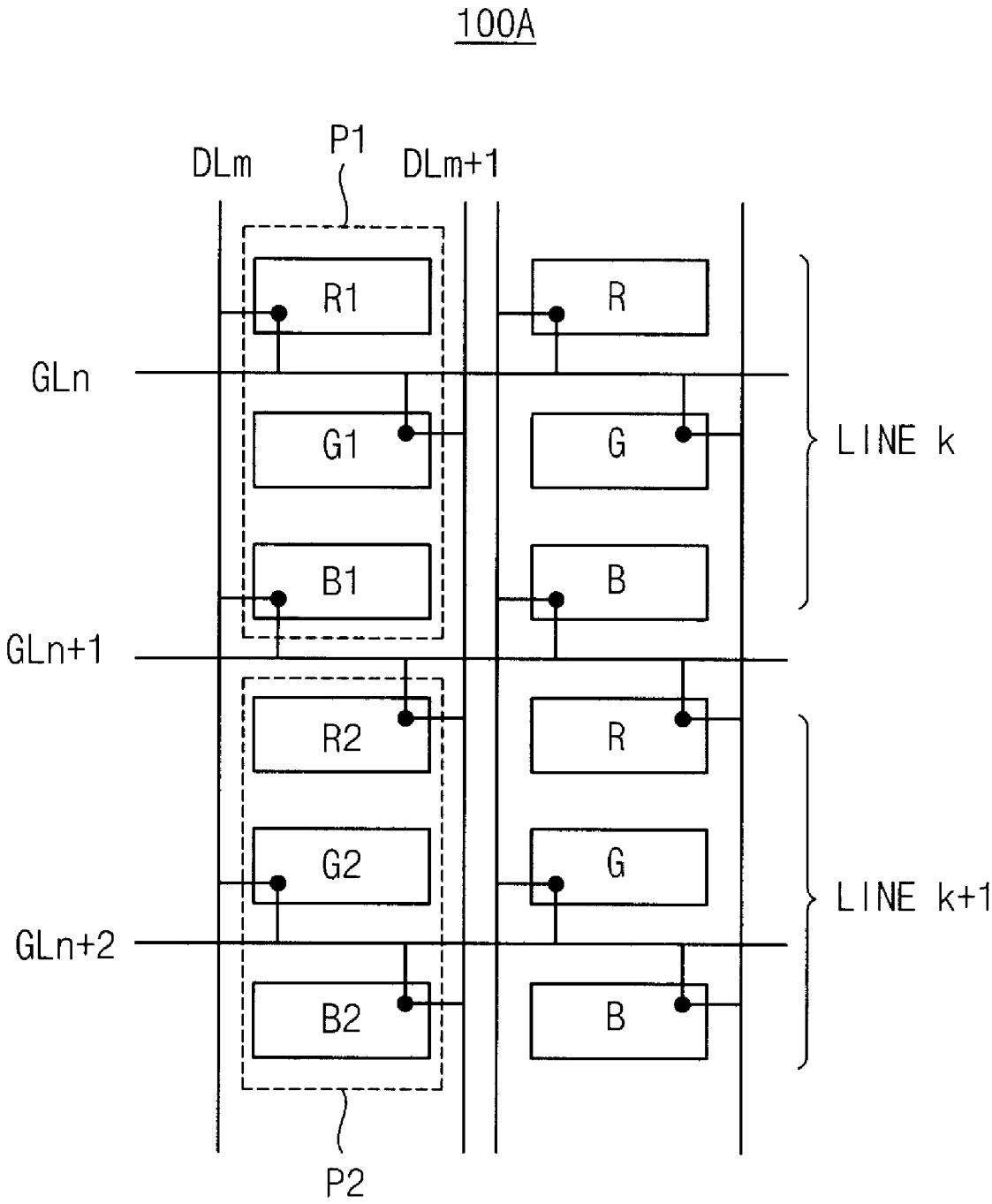
FIG. 3 is a diagrammatic top plan view illustrating another exemplary embodiment of a pixel structure of the exemplary embodiment of the display apparatus in FIG. 1.

FIG. 3 is a diagrammatic top plan view illustrating another exemplary embodiment of a pixel structure according to another exemplary embodiment of the display apparatus in FIG. 1.

Referring to FIGS. 1, 2 and 3, compared to the pixel structures of FIG. 2, on the display panel 100A, a k-th unit pixel row LINE k and a (k+1)-th unit pixel row LINE (k+1)-th are defined in a direction substantially parallel with the first direction. Accordingly, the data lines DLm and DLm+1 extend in the second direction and the gate lines GLn, GLn+1 and GLn+2 extend in the first direction. Connecting structures of the data and gate lines and the pixels are substantially similar to the pixel structures of FIG. 2.

In one exemplary embodiment, the data driving part 150 is disposed at a side edge of the display panel 100A in a direction substantially parallel with the first direction. In one exemplary embodiment, the gate driving part 170 is disposed at a side edge of the display panel 100A substantially parallel with the second direction.

The display panel 100A may also be driven by the driving apparatus 200 driving the display panel 100 of FIG. 2 in a substantially similar way.

Figure 4:
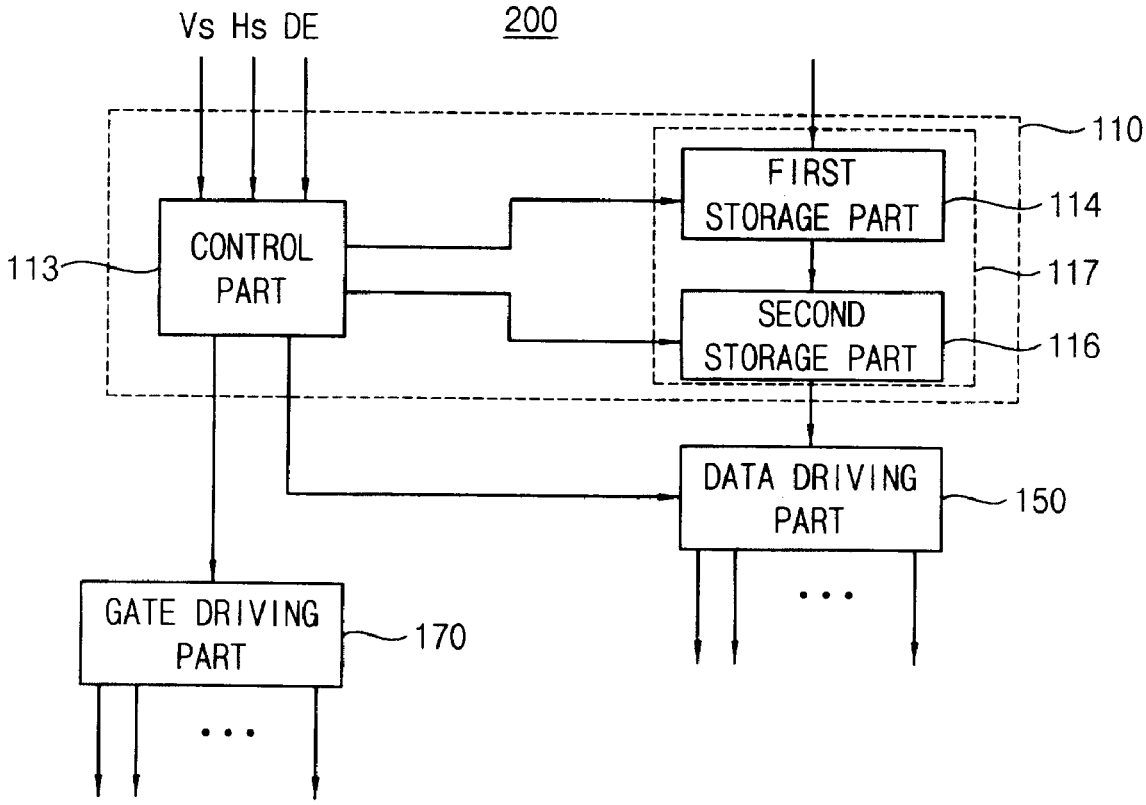
FIG. 4 is a block diagram illustrating an exemplary embodiment of a driving apparatus in FIG. 1.
Figure 5:
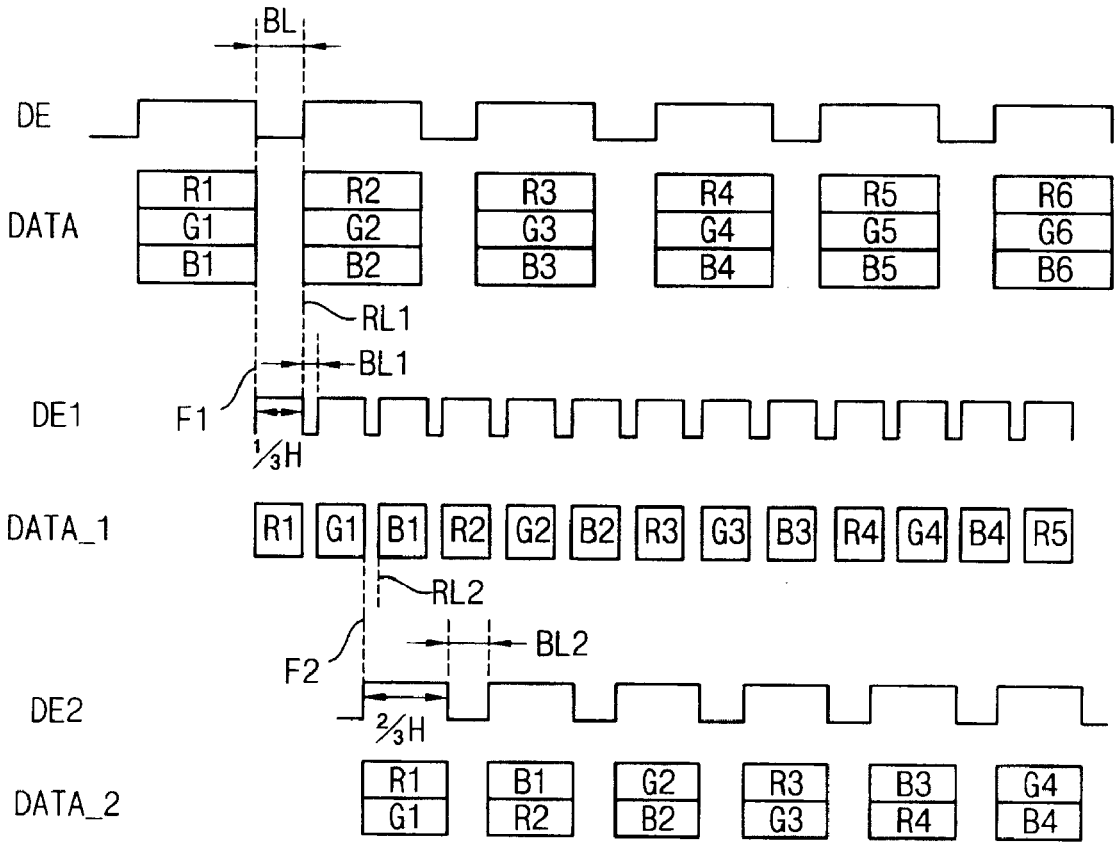
FIG. 5 is a waveform diagram illustrating an exemplary embodiment of a method for processing data to drive an exemplary embodiment of a display panel in FIG. 2.

FIG. 4 is a block diagram illustrating an exemplary embodiment of a driving apparatus 200 of FIG. 1. FIG. 5 is a waveform diagram illustrating an exemplary embodiment of a method for processing data to drive an exemplary embodiment of a display panel 100 in FIG. 2.

Referring to FIGS. 1, 2 and 4, the driving apparatus 200 includes a timing control part 110, a data driving part 150 and a gate driving part 170.

In the exemplary embodiment wherein the display panel 100 includes two unit pixels, the timing control part 110 binds up and divides six sub color data of the unit pixel row including two unit pixels two by two and processes the data according to pixel structures of a display panel of FIG. 2. The timing control part 110 includes a control part 113 and a storage part 117. The storage part 117 includes a first storage part 114 and a second storage part 116. In one exemplary embodiment, the storage part 117 is single port SRAM ("SPSRAM").

The control part 113 controls driving of the data driving part 150, the gate driving part 170 and the storage part 117 based on a received synchronizing signal including a vertical synchronizing signal Vs, a horizontal synchronizing signal Hs and a DE signal. The control part 113 provides a data control signal 113D including a horizontal start signal STH, a load signal TP, and other similar signals, to the data driving part 150. The control part 113 provides a gate control signal 113G including a vertical start signal STV, clock signals CK and CKB, and other similar signals, to the gate driving part 170. The control part 113 controls storage performance of the data in the storage part using the DE signal DE.

In one exemplary embodiment, the control part 113 receives the DE signal DE. The DE signal DE includes a pulse having a width corresponding to 1H and a blank BL period disposed between the pulses adjacent to each other. As previously described, the blank BL period may be randomly variable or may have a predetermined variability.

The control part 113 generates a first DE signal DE1 from a first falling moment F1 at which the pulse of the DE signal DE falls, e.g., goes from a high voltage to a low voltage. The first DE signal DE1 includes a first pulse having a width corresponding to ⅓H and a first blank BL1. The first pulse of the first DE signal DE1 rises at the first falling moment F1 and falls after ⅓H. The first blank BL1 is disposed between adjacent first pulses. In the present exemplary embodiment, the first blank BL1 has a width corresponding to ⅓ of the width of the blank BL of the DE signal, checked at a first rising moment RL1 at which the pulse of the DE signal DE rises, which in the exemplary embodiment shown in FIG. 5 is ⅙H.

The first storage part 114 divides the k-th and (k+1)-th lines R1, G1, B1, R2, G2 and B2 one by one and stores the data one by one in synchronicity with the first DE signal as illustrated by DATA_1. In the exemplary embodiment wherein a single port is used for the storage part 117, a storage capacity of six lines of data, each data unit being ⅓H is used for reading and writing, resulting in a capacity of 6/3 lines.

The control part 113 generates a second DE signal DE2 from a second falling moment F2 at which the second first pulse of the first DE signal DE1 falls. The second DE signal DE2 includes a second pulse having a width corresponding to ⅔H and a second blank BL2. The second pulse rises at the second falling moment F2 and falls after ⅔H. The second blank BL2 is disposed between the second pulses. In the present exemplary embodiment, the second blank BL2 has a width corresponding to twice the width of the first blank BL1 checked at a second rising moment RL2 at which the third first pulse rises, e.g., in the present exemplary embodiment the second blank has a period of ⅔H. The second blank BL2 may have a width corresponding to the sum of two checked blanks B1.

The second storage part 116 reads two of the data R1, G1, B1, R2, G2 and B2 stored in the first storage part 114 and stores the two data as illustrated by DATA_2. The second storage part 116 binds up and stores the red data R1 and the green data G1 in ⅔H of the second DE signal DE2. Sequentially, the second storage part 116 binds up and stores the blue data B1 and the red data R2 and binds up and stores the green data G2 and the blue data B2. In the exemplary embodiment wherein the storage part uses a single port, a storage capacity of two lines of data being ⅔H each is used for reading and writing, resulting in a capacity of 4/3 lines.

As a result, the storage part 117 has a storage capacity of 10/3 lines.

According to the present exemplary embodiment of a method of processing data, though the width of the blank of the received DE signal DE is randomly variable, the data corresponding to ⅔H may be obtained precisely from the storage part 117.

When the storage part 117 is SPSRAM having a single port, a comparative driving apparatus which outputs six sub color data of the k and (k+1)-th lines LINE k and LINE (k+1)-th by binding up and dividing the data two by two and outputting the data three times, generally has a storage capacity of four lines. However, the exemplary embodiments of a driving apparatus according to the present invention may have a capacity of 10/3 lines, which is ⅔ lines less than four lines. Therefore, a smaller storage part may be used and associated manufacturing costs of the display may be decreased.

Figure 6:
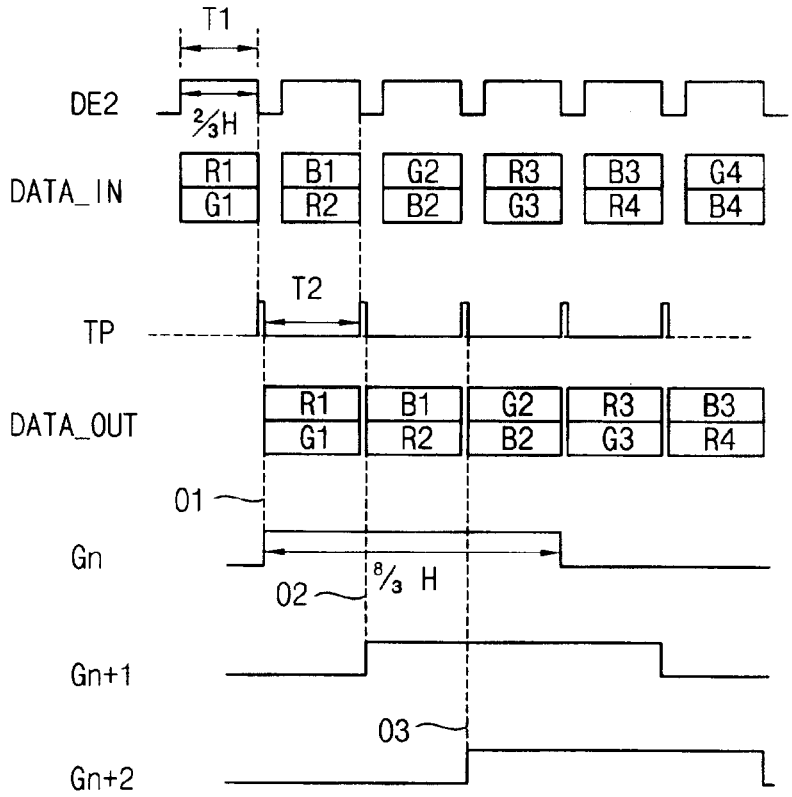
FIG. 6 is a waveform diagram illustrating an exemplary embodiment of a method for driving an exemplary embodiment of a display panel in FIG. 1.

FIG. 6 is a waveform diagram illustrating an exemplary embodiment of a method for driving an exemplary embodiment of a display panel in FIG. 1.

Referring to FIGS. 1, 2 and 6, the data driving part 150 responds to the second DE signal DE2. The driving part 150 receives the red data R1 and the green data G1 during a first period T1 corresponding to ⅔H. The data driving part 150 responds to the load signal TP provided from the timing control part 110. The data driving part 150 converts the red data R1 and the green data G1 into a data voltage having an analog type, e.g., an analog data voltage. The data driving part 150 outputs the data voltage to the m-th and (m+1)-th data lines DLm and DLm+1.

The gate driving part 170 sequentially outputs n-th gate signal Gn, (n+1)-th gate signal Gn+1 and (n+2)-th gate signal Gn+2 to the n, (n+1)-th and (n+2)-th gate lines GLn, GLn+1 and GLn+2, respectively. A rising period of the n-th gate signal Gn is synchronized with a moment 01 at which the red data R1 and the green data G1 of the k line are outputted. The n-th gate signal Gn is output to the n-th gate line GLn. A rising period of the (n+1)-th gate signal Gn+1 is synchronized with a moment 02 at which the blue data B1 of the k line and the red data R2 of the (k+1)-th line are output. The (n+1)-th gate signal Gn+1 is output to the (n+1)-th gate ling GLn+1. A rising period of the (n+2)-th gate signal Gn+2 is synchronized with a moment 03 at which the green data G2 and the blue data B2 of the (k+1)-th line are output. The (n+2)-th gate signal Gn+2 is output to the (n+2)-th gate line GLn+2. Exemplary embodiments include configurations wherein the width of a pulse of the gate signal is set more than ⅔H in order to allow for a sufficient charging time of the data voltages to the pixels. In the exemplary embodiment illustrated in FIG. 6, the width of a pulse of the gate signal is 8/3H.

Figure 7:
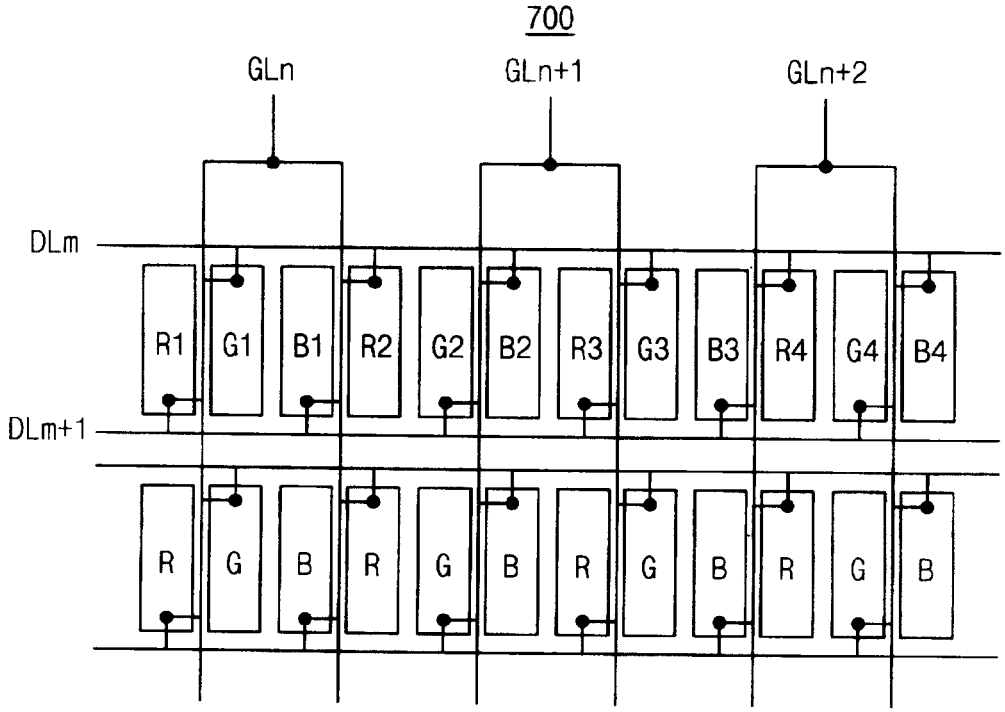
FIG. 7 is a diagrammatic top plan view illustrating another exemplary embodiment of a pixel structure of an exemplary embodiment of a display panel according to the present invention.

FIG. 7 is a diagrammatic top plan view illustrating another exemplary embodiment of a pixel structure of another exemplary embodiment of a display panel according to the present invention.

Referring to FIG. 7, the display panel 700 includes a plurality of data lines DLm and DLm+1, a plurality of gate lines GLn, GLn+1 and GLn+2 and a plurality of unit pixels P. Each unit pixel P includes a red pixel R, a green pixel G and a blue pixel B.

In the present exemplary embodiment, the data lines DLm and DLm+1 extend in the first direction. The gate lines GLn, GLn+1 and GLn+2 extend in the second direction substantially perpendicular to the first direction. A first unit pixel P1 includes a first red pixel R1, a first green pixel G1 and a first blue pixel B1 which are disposed sequentially in the first direction. A second unit pixel P2 is disposed adjacent to the first unit pixel P1 in the first direction. The second unit pixel P2 includes a second red pixel R2, a second green pixel G2 and a second blue pixel B2 which are sequentially disposed in the first direction. A third unit pixel P3 is disposed adjacent to the second unit pixel P2 in the first direction. The third unit pixel P3 includes a third red pixel R3, a third green pixel G3 and a third blue pixel B3 which are sequentially disposed in the first direction. A fourth unit pixel P4 is disposed adjacent to the third unit pixel P3 in the first direction. The fourth unit pixel P4 includes a fourth red pixel R4, a fourth green pixel G4 and a fourth blue pixel B4 which are sequentially disposed in the first direction.

A pair of the data lines DLm and DLm+1 is electrically and regularly connected to the color pixels of a first color pixel row disposed in the first direction. In the present exemplary embodiment, the m-th data line DLm is connected to the first green pixel G1, the second red pixel R2, the second blue pixel B2, the third green pixel G3, the fourth red pixel R4 and the fourth blue pixel B4. The (m+1)-th data line DLm+1 is connected to the first red pixel R1, the first blue pixel B1, the second green pixel G2, the third red pixel R3, the third blue pixel B3 and the fourth green pixel G4.

In the present exemplary, a single one of the gate lines is electrically connected to four of the color pixels of the second color pixel row, e.g., in a column direction, which are adjacent to each other in the first direction. In the present exemplary embodiment, the n-th gate line GLn is electrically connected to the first red pixel R1, the first green pixel G1, the first blue pixel B1 and the second red pixel R2. The (n+1)-th gate line GLn+1 is connected to the second green pixel G2, the second blue pixel B2, the third red pixel R3 and third green pixel G3. The (n+2)-th gate line GLn+2 is connected to the third blue pixel B3, the fourth red pixel R4, the fourth green pixel G4 and the fourth blue pixel B4.

In one exemplary embodiment, k-th, (k+1)-th, (k+2)-th and (k+3)-th unit pixels LINE k, LINE (k+1)-th, LINE k+2 and LINE k+3 are electrically connected to three of gate lines GLn, GLn+1 and GLn+2.

Figure 8:
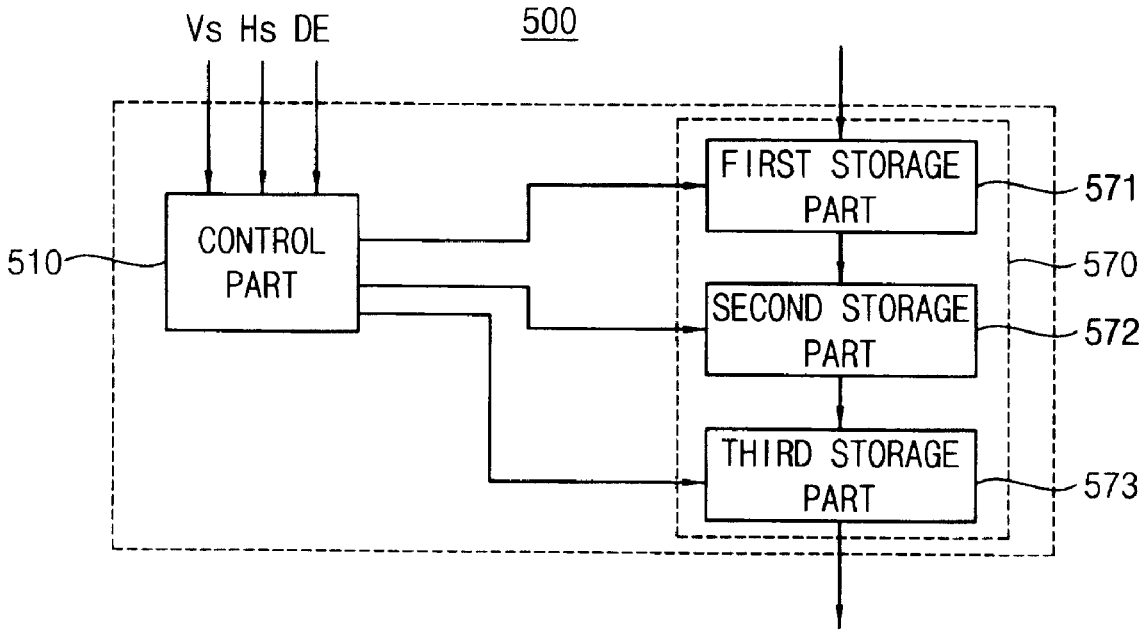
FIG. 8 is a block diagram illustrating an exemplary embodiment of a timing control part for driving the exemplary embodiment of a display panel in FIG. 7.
Figure 9:
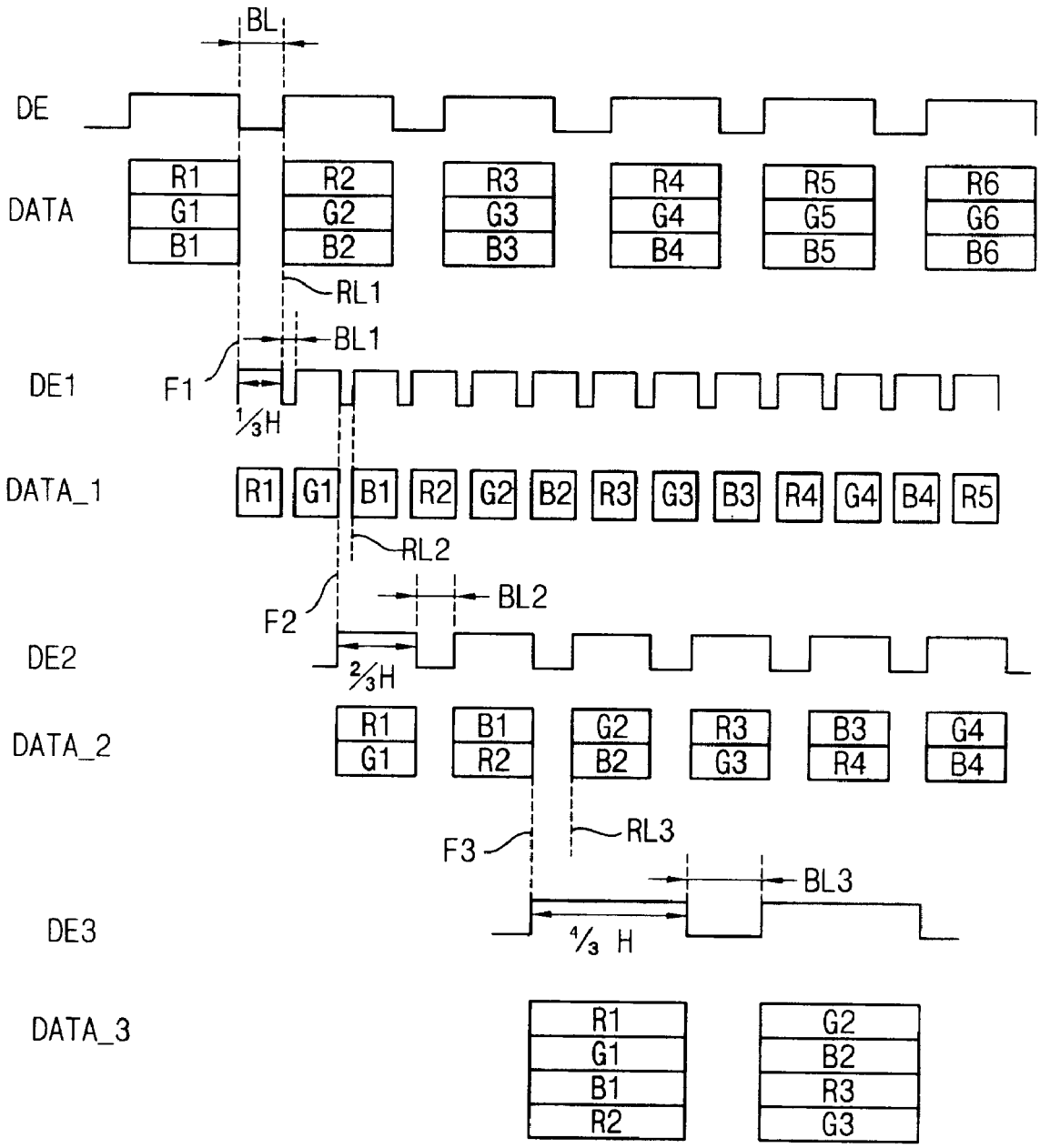
FIG. 9 is a waveform diagram illustrating an exemplary embodiment of a method for processing data to drive the exemplary embodiment of a display panel in FIG. 7.

FIG. 8 is a block diagram illustrating an exemplary embodiment of a timing control part 500 for driving the exemplary embodiment of a display panel in FIG. 7. FIG. 9 is a waveform diagram illustrating an exemplary embodiment of a method for processing data to drive the exemplary embodiment of a display panel in FIG. 7.

Referring to FIGS. 1, 7, 8 and 9, the timing control part 500 binds up and divides twelve sub color data of the unit pixel row including four unit pixels into data sets including data for four pixels and processes the data according to pixel structures of a display panel in FIG. 7.

The timing control part 500 includes a control part 510 and a storage part 570.

The control part 510 controls the performance of the storage part 570 using the DE signal DE.

In one exemplary embodiment, the control part 510 receives the DE signal DE. The DE signal DE includes a pulse having a width corresponding to 1H and a blank period BL disposed between the pulses adjacent to each other. As discussed above, the blank BL may be randomly variable or may have a predetermined period.

The control part 510 generates a first DE signal DE1 from a first falling moment F1 at which the pulse of the DE signal DE falls, similar to the previous exemplary embodiment. The first DE signal DE1 includes a first pulse having a width corresponding to ⅓H and a first blank BL1. The first pulse rises at the first falling moment F1 and falls after ⅓H. The first blank BL1 is disposed between the first pulses. In the present exemplary embodiment, the first blank BL1 has a width corresponding to ⅓ of the width of the blank BL checked at a first rising moment RL1 at which the pulse of the DE signal DE rises, e.g., in the present exemplary embodiment the first blank BL1 has a period of ⅙H.

The first storage part 571 divides data of the k and (k+1)-th lines R1, G1, B1, R2, G2 and B2 one by one and stores the data one by one in synchronicity with the first pulse as illustrated by DATA_1. In the exemplary embodiment wherein the first storage part 571 uses a single port, a storage capacity of six lines of ⅓H each is used for reading and writing, resulting in a capacity of 6/3 lines.

The control part 510 generates a second DE signal DE2 from a second falling moment F2 at which the second first pulse of the first DE signal DE1 falls. The second DE signal DE2 includes a second pulse having a width corresponding to ⅔H and a second blank BL2. The second pulse rises at the second falling moment F2 and falls after ⅔H. The second blank BL2 is disposed between the second pulses. The second blank BL2 has a width corresponding to twice the width of the first blank BL1 checked at a second rising moment RL2 at which the third first pulse rises, which in the present exemplary embodiment if ⅚H. In one exemplary embodiment, the second blank BL2 may have a width corresponding to the sum of the two checked blanks BL1.

The second storage part 572 reads two of the data R1, G1, B1, R2, G2 and B2 stored in the first storage part 571 and stores the two data illustrated as DATA_2. The second storage part 572 binds up and stores the red data R1 and the green data G1 in ⅔H of the second DE signal DE2. Sequentially, the second storage part 572 binds up and stores the blue data B1 and the red data R2 and binds up and stores the green data G2 and the blue data B2. In the exemplary embodiment wherein the second storage part 572 includes a single port, a storage capacity of two lines of ⅔H each is used for reading and writing, resulting in a capacity of 4/3 lines.

The control part 510 generates a third pulse having a width corresponding to 4/3H from a third falling moment F3 at which the second pulse of the second DE signal DE2 falls. The control part 510 generates a third blank BL3 having a width corresponding to twice the width of the second blank BL2 checked at a third rising moment RL3 at which the second pulse rises between the third pulses adjacent to each other, which in the present exemplary embodiment is ⅘H. In one exemplary embodiment, the third blank BL3 may have a width corresponding to the sum of the two checked blanks BL2.

The control part 510 generates a third DE signal DE3 from the third falling moment F3 at which the second pulse of the second DE signal DE2 falls. The third DE signal DE3 includes the third pulse having a width corresponding to 4/3H and the third blank BL3. The third pulse rises at the third falling moment F3 and falls after 4/3H and a third blank BL3 disposed between the third pulses. As described above, the third blank BL3 has a width corresponding to twice the width of the second blank BL2 checked at the third rising moment RL3 at which the third second pulse rises, and exemplary embodiments include configurations wherein the third blank BL3 may have a width corresponding to the sum of the two checked blanks BL2.

The third storage part 573 binds up the data DATA_2 stored in the second storage part 572 two by two and stores the data two by two based on the third DE signal DE3 illustrated as DATA_3. The data DATA_3 stored in the third storage part 573 includes data voltages for four individual color pixels.

In one exemplary embodiment, the third storage part 573 binds up and stores the red and green data R1 and G1 and the blue and red data B1 and R2. Sequentially, the third storage part 573 binds up and stores the green and blue data G2 and R2 and the red and green data R3 and G3 and binds up and stores the blue and red data B3 and R4 and the green and blue data G4 and B4. In the exemplary embodiment wherein the third storage part uses a single port, a storage capacity of two lines of 4/3H each is used for reading and writing, resulting in a total capacity of 8/3 lines.

As a result, the storage part 570 has a storage capacity of 6 lines, e.g., the sum of the storage capacity of the first storage part 571, the second storage part 572 and the third storage part 573.

According to the exemplary embodiment of a method for processing the data, though the width of the blank of the received DE signal DE is randomly variable, the data corresponding to 4/3H may be obtained precisely from the storage part 570. When the storage part 570 is SPSRAM having a single port, a comparative driving apparatus which outputs twelve sub color data of the k-th, (k+1)-th, (k+2)-th and (k+3)-th lines LINE k, LINE (k+1)-th, LINE k+2 and LINE k+3 by binding up and dividing the data four by four and outputting the data three times, generally has a storage capacity of eight lines. However, an exemplary embodiment of the driving apparatus according to the present invention may have a capacity of six lines, which is considerably less than eight lines. Therefore, the exemplary embodiment of a driving apparatus of the present invention uses less memory and may have lower associated manufacturing costs.

According to the present invention, sub color data of a unit pixel row including a plurality of unit pixels are processed by binding up the sub color data. The sub color data of the unit pixel row including the unit pixels are divided one by one and the sub color data are stored one by one. Then, the stored sub color data are bound up two by two and the sub color data are stored. Then, the procedure of binding up the bound-up sub color data two by two and storing the bound-up sub color data is repetitively performed until the sub color data includes M sub color data (wherein M is a natural number equal or greater than 2). According to the method of processing data, the size of a storage part may be decreased. In the procedure of dividing the sub color data one by one and storing the sub color data one by one, a variable width of a blank may be checked. Accordingly, the data may be easily processed corresponding to the variable width of the blank.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method for processing image data, the image data including a plurality of sub color data corresponding to a plurality of unit pixels in a row direction, wherein each unit pixel includes N sub color pixels having different colors, wherein N is a natural number greater than or equal to 2, the method comprising:

storing one sub color datum of the plurality of the sub color data corresponding to the unit pixels after dividing the plurality of the sub color data one by one into an individual sub color datum, each individual sub color datum corresponding to a single pixel;

reading the stored sub color data;

binding up the stored sub color data two by two; and storing two sub color data bound up with each other.

2. The method of claim 1, further comprising repeatedly binding up the stored sub color data two by two to store two sub color data bound up with each other, until the two sub color data bound up with each other includes M sub color data, wherein M is a natural number greater than or equal to 2.

3. The method of claim 1, further comprising:

receiving a data enable signal including a pulse corresponding to one horizontal period 1H, and a blank disposed between sequential pulses; and generating a first data enable signal including a first pulse and a first blank, the first pulse being synchronized with the pulse and having a first width corresponding to 1/N of a horizontal period, the first blank being disposed between sequential first pulses and having a period substantially equal to the blank divided by N, and wherein the sub color data corresponding to the unit pixels are divided into one by one in response to the first pulse to store one of the sub color data.

4. The method of claim 3, further comprising generating a second data enable signal including a second pulse and a second blank, the second pulse being synchronized with the first pulse and having a second width corresponding to 2/N of a horizontal period, the second blank being disposed between sequential second pulses and having two first blank periods, wherein the stored sub color data in response to the second pulse of the second data enable signal are bound up two by two, to store two sub color data bound up with each other.

5. The method of claim 4, further comprising generating a (k+1)-th data enable signal including a (k+1)-th pulse and k-th blank, the (k+1)-th pulse being synchronized with the k-th pulse and having a width corresponding to twice a width of the k-th pulse, the (k+1)-th blank having a period corresponding to two k-th blanks, using a k-th data enable signal having the k-th pulse and the k-th blank, wherein k is a natural number greater than or equal to 1.

6. The method of claim 1, wherein the unit pixel comprises red color data, green color data and blue color data.

7. A driving apparatus which processes sub color data, each unit pixel including N sub color pixels, the sub color data corresponding to a plurality of unit pixels, wherein N is a natural number greater than or equal to 2, the driving apparatus comprising:

a control part which generates a first data enable signal and a second data enable signal, the first data enable signal including a first pulse and a first blank, the second data enable signal including a second pulse and a second blank, the first pulse being synchronized with a pulse corresponding to one horizontal period 1H and having a width corresponding to a 1/N horizontal period, the first blank being disposed between sequential first pulses and having a period substantially equal to a blank between the pulses divided by N, the second pulse being synchronized with the first pulse and having a width corresponding to a 2/N horizontal period, the second blank being disposed between sequential second pulses and having second blank periods; and a storage part which divides the sub color data corresponding to the unit pixels one by one in response to the first pulse, and which stores the sub color data two by two in response to the second pulse.

8. The driving apparatus of claim 7, wherein the storage part comprises:

a first storage part which divides the sub color data corresponding to the unit pixels one by one in response to the first pulse to store the sub color data one by one; and a second storage part which binds up the sub color data stored in the first storage part two by two in response to the second pulse to store the sub color data two by two.

9. The driving apparatus of claim 8, wherein the control part generates a (k+1)-th data enable signal including a (k+1)-th pulse and a (k+1)-th blank, the (k+1)-th pulse being synchronized with a k-th pulse and having a width corresponding to about twice a width of the k-th pulse, the (k+1)-th blank having a period corresponding to about two k-th blanks, using a k-th data enable signal having the k-th pulse and the k-th blank, wherein k is a natural number greater than or equal to 1.

10. The driving apparatus of claim 9, wherein the storage part further comprises a third storage part which binds up the sub color data two by two in response to the (k+1)-th pulse, and the sub color data is stored in response to the k-th pulse.

11. The driving apparatus of claim 7, wherein the unit pixel comprises red color data, green color data and blue color data.

12. The driving apparatus of claim 7, further comprising:

a data driving part which converts sub color data output from the storage part into analog data voltages; and a gate driving part which is synchronized with an output signal output from the data driving part and which outputs a gate signal.

13. A display apparatus comprising:

a display panel comprising:

a plurality of unit pixels, each unit pixel having N sub color pixels;

a color pixel row extending along a first direction and including a plurality of the sub color data;

a color pixel column extending along a second direction substantially perpendicular to the first direction and including a plurality of the sub color data;

a data line electrically connected to the color pixel row; and a gate line electrically connected to adjacent pixels of the color pixel column; and a driving apparatus which provides sub color data to the display panel, the N sub color data of the unit pixel including the respective N sub color pixels, the sub color data corresponding to a plurality of unit pixels, wherein N is a natural number greater than or equal to 2, the driving apparatus comprising:

a control part which generates a first data enable signal and a second data enable signal, the first data enable signal including a first pulse and a first blank, the second data enable signal including a second pulse and a second blank, the first pulse being synchronized with a pulse corresponding to one horizontal period 1H and having a width corresponding to 1/N of a horizontal period, the first blank being disposed between sequential first pulses and having a period substantially equal to a blank between sequential pulses divided by N, a second pulse being synchronized with the first pulse and having a width corresponding to a 2/N of a horizontal period, the second blank being disposed between sequential second pulses and having a period substantially equal to two first blank periods; and a storage part which divides the sub color data corresponding to the unit pixels one by one in response to the first pulse, and which stores the sub color data two by two in response to the second pulse.

14. The display apparatus of claim 13, wherein the storage part comprises:

a first storage part which divides the sub color data corresponding to the unit pixels one by one in response to the first pulse to store the sub color data one by one; and a second storage part which binds up the sub color data stored in the first storage part two by two in response to the second pulse to store the sub color data two by two.

15. The display apparatus of claim 14, wherein the control part generates a (k+1)-th data enable signal including a (k+1)-th pulse and a (k+1)-th blank, the (k+1)-th pulse being synchronized with a k-th pulse and having a width corresponding to about twice a width of the k-th pulse, the (k+1)-th blank having a period corresponding to about two k-th blanks, using a k-th data enable signal having the k-th pulse and the k-th blank, wherein k is a natural number greater than or equal to 1.

16. The display apparatus of claim 15, wherein the storage part further comprises a third storage part which binds up the sub color data two by two in response to the (k+1)-th pulse, and the sub color data is stored in response to the k-th pulse.

17. The display apparatus of claim 13, wherein a pair of the data lines is electrically and alternatively connected to the color pixel row and one gate line is electrically connected to two color pixel columns.

18. The display apparatus of claim 13, wherein the control part generates a third data enable signal including a third pulse and a third blank when the sub color data are bound up 4 by 4, the third pulse is synchronized with the second pulse and has a width corresponding to a 4/N horizontal period, and a third blank is disposed between sequential third pulses and has two second blank periods, and wherein the storage part further comprises a third storage part which reads the sub color data stored in the second storage part and binds up the sub color data two by two in response to the third pulse to store the sub color data two by two.

19. The display apparatus of claim 18, wherein the pair of the data lines is electrically and alternatively connected to the color pixel row and one gate line is electrically connected to four color pixel columns.

20. The display apparatus of claim 13, wherein the driving apparatus further comprises:

a data driving part which converts sub color data output from the storage part into analog data voltages; and a gate driving part synchronized with an output signal output from the data driving part, wherein the gate driving part outputs a gate signal.

* * * * *